US007520730B2

(12) United States Patent
Yoo et al.

(10) Patent No.: US 7,520,730 B2
(45) Date of Patent: Apr. 21, 2009

(54) APPARATUS AND METHOD FOR CONTROLLING OPERATION OF COMPRESSOR

(75) Inventors: Jae-Yoo Yoo, Gyeonggi-Do (KR); Chel-Woong Lee, Seoul (KR); Ji-Won Sung, Seoul (KR)

(73) Assignee: LG Electronics Inc., Seoul (KR)

( * ) Notice: Subject to any disclaimer, the term of this patent is extended or adjusted under 35 U.S.C. 154(b) by 791 days.

(21) Appl. No.: 11/033,281

(22) Filed: Jan. 12, 2005

(65) Prior Publication Data

US 2006/0056980 A1 Mar. 16, 2006

(30) Foreign Application Priority Data

Sep. 11, 2004 (KR) ..... 10-2004-0072825

(51) Int. Cl.
*F04B 49/06* (2006.01)

(52) U.S. Cl. ..... 417/44.11; 417/44.1; 417/53; 417/417; 318/459

(58) Field of Classification Search ..... 318/459, 318/500

See application file for complete search history.

(56) References Cited

U.S. PATENT DOCUMENTS

| | | | | |
|---|---|---|---|---|
| 4,706,470 | A * | 11/1987 | Akazawa et al. | 62/209 |
| 6,075,671 | A * | 6/2000 | Yoneda et al. | 360/75 |
| 6,644,943 | B1 | 11/2003 | Lilie et al. | |
| 2003/0026702 | A1 * | 2/2003 | Yoo et al. | 417/44.11 |
| 2003/0143080 | A1 * | 7/2003 | Yoo et al. | 417/44.1 |

* cited by examiner

*Primary Examiner*—Devon C Kramer
*Assistant Examiner*—Philip Stimpert
(74) *Attorney, Agent, or Firm*—Birch, Stewart, Kolasch & Birch, LLP

(57) ABSTRACT

An apparatus for controlling an operation of a compressor includes: a back electromotive force calculator for calculating a back electromotive force of a compressor based on a value of a current applied to a motor of the compressor and a value of a voltage applied to the motor of the compressor; an operation frequency reference value determining unit for detecting a mechanical resonance frequency of the compressor based on the back electromotive force value and the current value and determining the detected mechanical resonance frequency as an operation frequency reference value; and a controller for varying an operation frequency of the compressor according to the determined operation frequency reference value.

17 Claims, 4 Drawing Sheets

APPARATUS AND METHOD FOR CONTROLLING OPERATION OF COMPRESSOR

BACKGROUND OF THE INVENTION

1. Field of the Invention

The present invention relates to a compressor and, more particularly, to an apparatus and method for controlling an operation of a reciprocating compressor.

2. Description of the Prior Art

In general, a reciprocating compressor does not employ a crank shaft for converting a rotational motion to a linear motion, so it has higher compression efficiency than a general compressor.

When the reciprocating compressor is used for a refrigerator or an air-conditioner, a compression ratio of the reciprocating compressor can be varied by varying a stroke voltage inputted to the reciprocating compressor in order to control cooling capacity.

A conventional reciprocating compressor will now be described with reference to FIG. 1.

FIG. 1 is a block diagram showing the construction of an apparatus for controlling an operation of a reciprocating compressor in accordance with a prior art.

As shown in FIG. 1, a conventional apparatus for controlling an operation of a reciprocating compressor includes: a current detector 4 for detecting a current applied to a motor (not shown) of a reciprocating compressor 6; a voltage detector 3 for detecting a voltage applied to the motor; a stroke calculator 5 for calculating a stroke estimate value of the compressor based on the detected current and voltage values and a parameter of the motor; a comparator 1 for comparing the calculated stroke estimate value and a pre-set stroke reference value and outputting a different value according to the comparison result; and a stroke controller 2 for controlling an operation (stroke) of the compressor 6 by varying a voltage applied to the motor according to the difference value.

The apparatus for controlling an operation of the reciprocating compressor operates as follows.

First, the current detector 4 detects a current applied to the motor of the compressor 6 and outputs the detected current value to the stroke calculator 5. At this time, the voltage detector 3 detects a voltage applied to the motor and outputs the detected voltage value to the stroke calculator 5.

The stroke calculator 5 calculates a stroke estimate value (X) of the compressor by substituting the detected current and voltage values and a parameter of the motor to equation (1) shown below and applies the obtained stroke estimate value (X) to the comparator 1.

$$X = \frac{1}{\alpha}\int (V_M - Ri - L\dot{i})dt \tag{1}$$

wherein 'R' is a motor resistance value, 'L' is a motor inductance value, a is a motor constant value, $V_M$ is a value of a voltage applied to the motor, 'i' is a value of a current applied to the motor, and '$\dot{i}$' is a time change rate of the current applied to the motor. Namely, '$\dot{i}$' is a differentiated value of 'i' (di/dt).

The comparator 1 compares the stroke estimate value with the stroke reference value and applies a difference value according to the comparison result to the stroke controller 2.

The stroke controller 2 controls the stroke of the compressor 6 by varying a voltage applied to the motor of the compressor 6 based on the difference value. This will be described with reference to FIG. 2.

FIG. 2 is a flow chart of a method for controlling an operation of the reciprocating compressor in accordance with the prior art.

First, when the stroke calculate 5 applies the stroke estimate value to the comparator 1 (step S1), the comparator 1 compares the stroke estimate value with the pre-set stroke reference value (step S2) and outputs a difference value according to the comparison result to the stroke controller 2.

If the stroke estimate value is smaller than the stroke reference value, the stroke controller 2 increases a voltage applied to the motor to control the stroke of the compressor (step S3). If, however, the stroke estimate value is greater than the stroke reference value, the stroke controller 2 reduces the voltage applied to the motor (step S4).

Thus, in the conventional apparatus and method for controlling an operation of the reciprocating compressor, even though a mechanical resonance frequency of the compressor is varied because of the change in the voltage applied to the motor of the compressor based on the stroke estimate value an the stroke reference value, the reciprocating compressor is operated with the always same operation frequency, causing a problem that operation efficiency of the reciprocating compressor deteriorates.

A reciprocating compressor in accordance with a different embodiment of the present invention is disclosed in U.S. Pat. No. 6,644,943 issued on Nov. 11, 2003.

SUMMARY OF THE INVENTION

Therefore, an object of the present invention is to provide an apparatus and method for controlling an operation of a compressor capable of enhancing operation efficiency of a compressor even though a load of the compressor is changed.

To achieve these and other advantages and in accordance with the purpose of the present invention, as embodied and broadly described herein, there is provided an apparatus for controlling an operation of a compressor including: a back electromotive force calculator for calculating a back electromotive force of a compressor based on a value of a current applied to a motor of the compressor and a value of a voltage applied to the motor of the compressor; an operation frequency reference value determining unit for detecting a mechanical resonance frequency of the compressor based on the back electromotive force value and the current value and determining the detected mechanical resonance frequency as an operation frequency reference value; and a controller for varying an operation frequency of the compressor according to the determined operation frequency reference value.

To achieve the above object, there is also provided an apparatus for controlling an operation of a compressor including: a current detector for detecting a current applied to a motor of a compressor; a voltage detector for detecting a voltage applied to the motor; a stroke calculator for calculating a stroke estimate value based on the detected current and voltage values and a parameter of the motor; a back electromotive force calculator for calculating a back electromotive force based on the voltage value of the voltage detector and the current value of the current detector; an operation frequency reference value determining unit for detecting a mechanical resonance frequency of the compressor based on the obtained back electromotive force value and the detected current value and determining the detected mechanical resonance frequency as an operation frequency reference value; a comparator for comparing the stroke estimate value outputted from the stroke calculator with a stroke reference value and outputting a difference value according to the comparison result; and a controller for controlling an operation of the compressor by varying a current operation frequency according to the determined operation frequency reference value and varying the voltage applied to the motor of the compressor according to the difference value outputted from the comparator.

To achieve the above object, there is also provided a method for controlling an operation of the compressor including: calculating a back electromotive force of a motor based on a value of a current applied to the motor of a compressor and a value of a voltage applied to the motor of the compressor; detecting a mechanical resonance frequency of the compressor based on the back electromotive force value and the value of the current; determining the mechanical resonance frequency as an operation frequency reference value of the compressor; and varying an operation frequency of the compressor according to the determined operation frequency reference value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
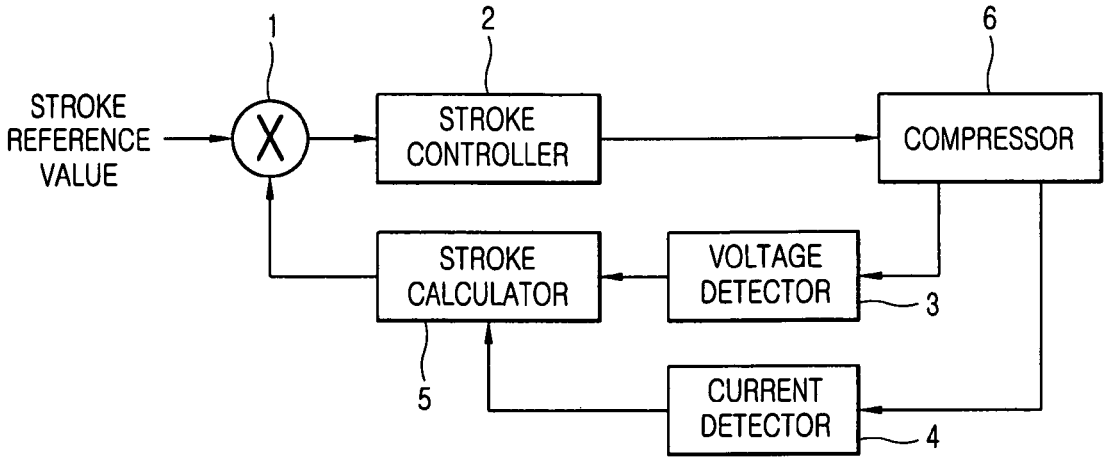
FIG. 1 PRIOR ART
FIG. 1 is a block diagram showing the construction of an apparatus for controlling an operation of a reciprocating compressor in accordance with a prior art.
Figure 2:
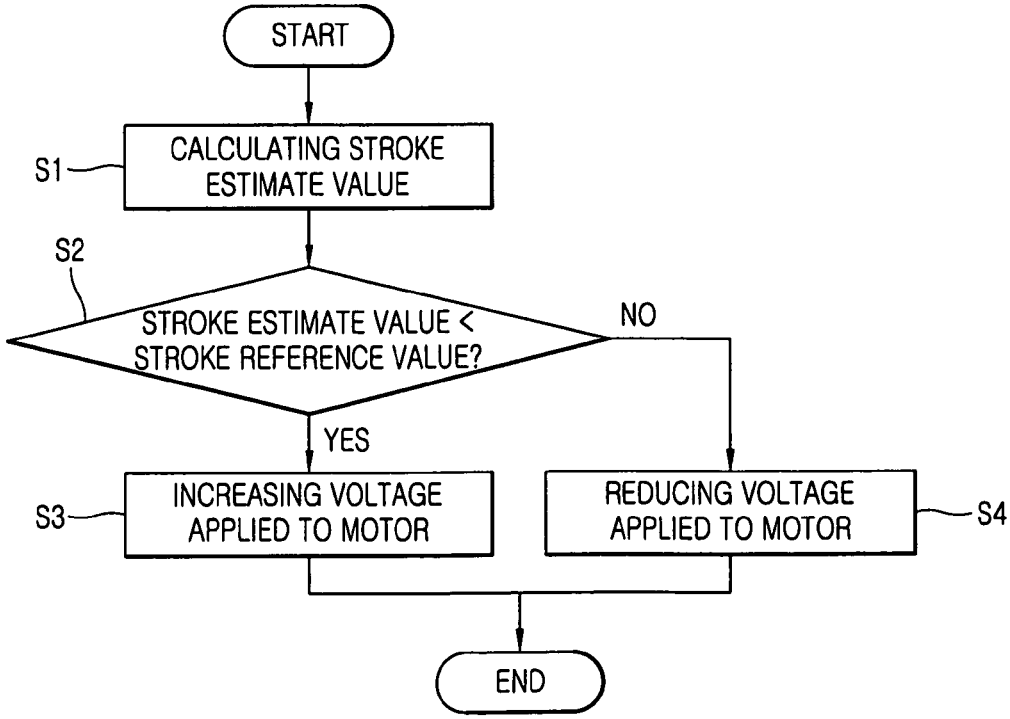
FIG. 2 PRIOR ART
FIG. 2 is a flow chart of a method for controlling the operation of the reciprocating compressor in accordance with the prior art.
Figure 3:
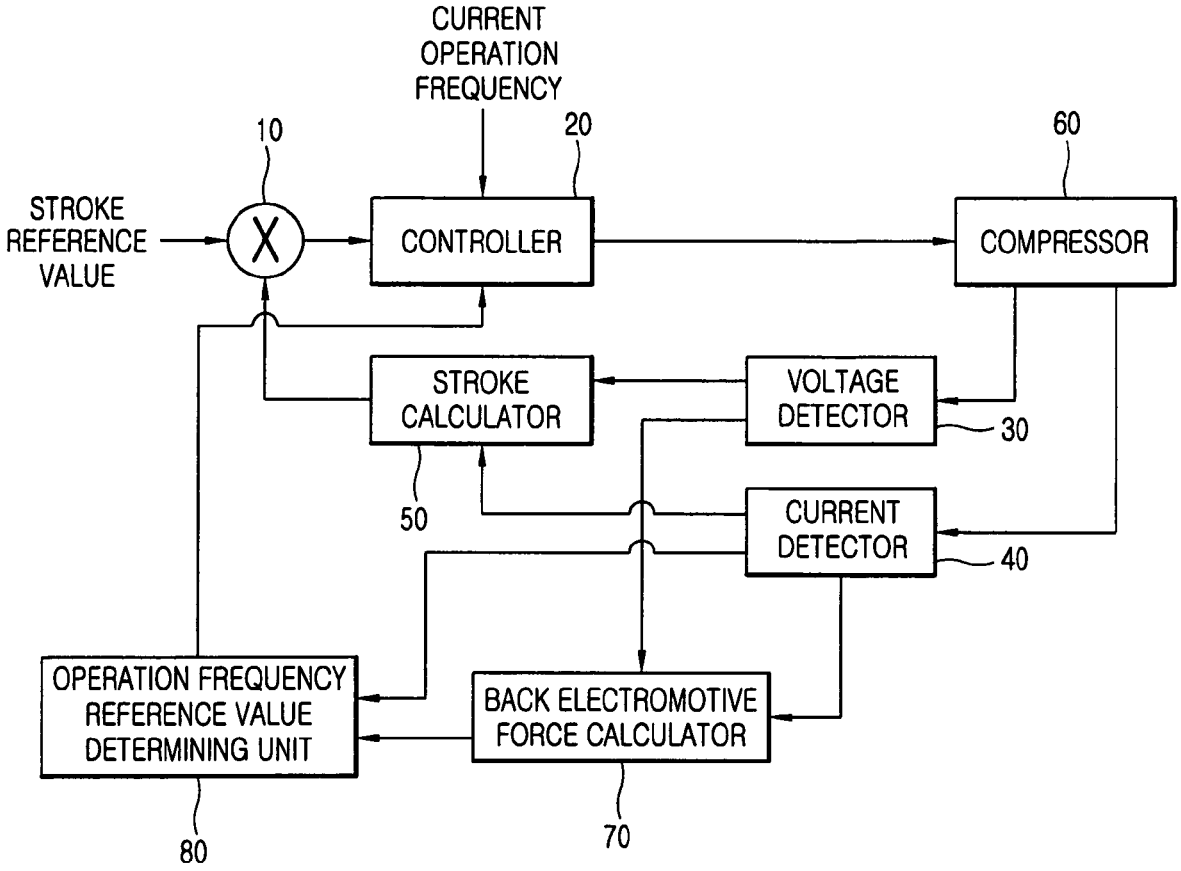
FIG. 3 is a block diagram showing the construction of an apparatus for controlling an operation of a reciprocating compressor in accordance with the present invention.
Figure 4A:
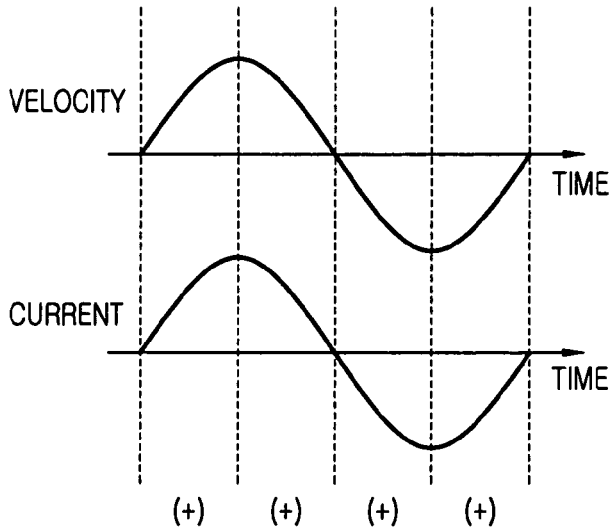
FIGS. 4A to 4C are graphs showing a phase of a current applied to a motor of the compressor and a velocity of the motor.
Figure 4B:
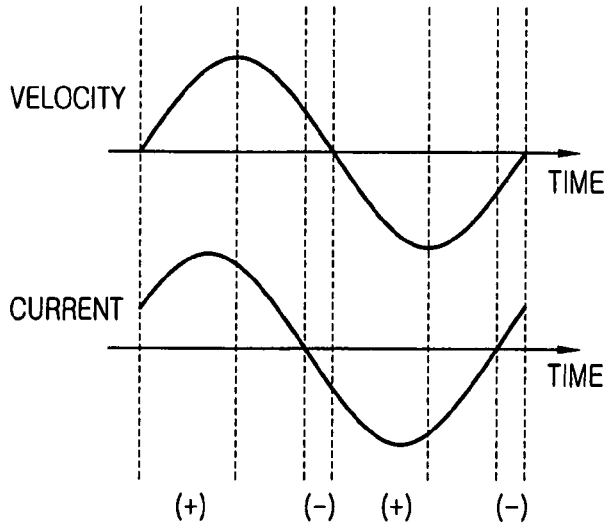
Figure 4C:
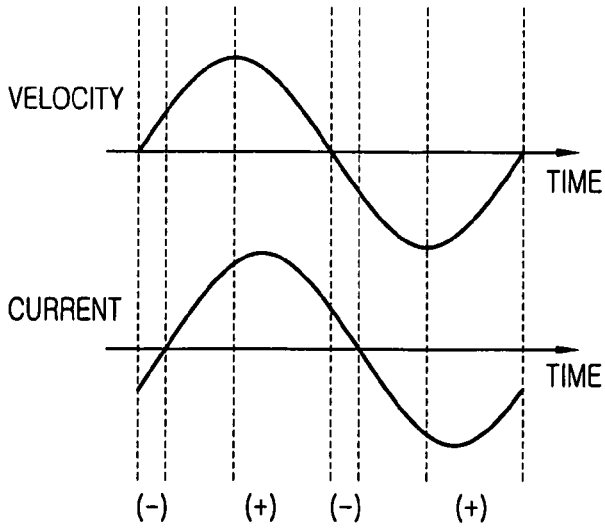
Figure 5:
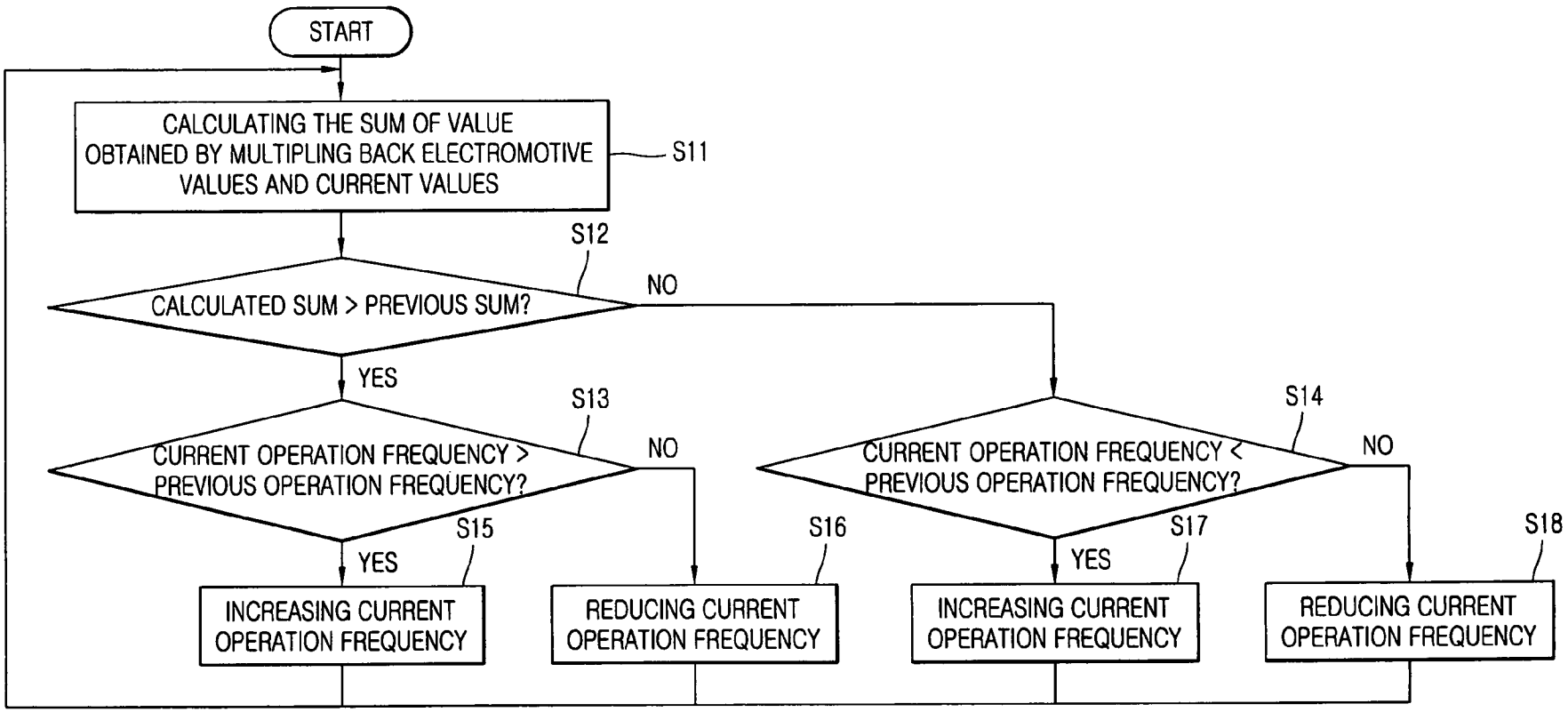
FIG. 5 is a flow chart of a method for controlling the operation of the reciprocating compressor in accordance with the present invention.

An apparatus and method for controlling an operation of a compressor capable of enhancing operation efficiency of a compressor even though a load of a compressor is changed by detecting a mechanical resonance frequency of the compressor based on a back electromotive force value and a current value of the compressor and varying an operation frequency of the compressor according to the mechanical resonance frequency, in accordance with a preferred embodiment of the present invention will now be described with reference to FIGS. 3 to 5.

FIG. 3 is a block diagram showing the construction of an apparatus for controlling an operation of a reciprocating compressor in accordance with the present invention.

As shown in FIG. 3, the apparatus for controlling an operation of a reciprocating compressor in accordance with the present invention includes: a current detector 40 for detecting a current applied to a motor (not shown) of a compressor 60; a voltage detector 30 for detecting a voltage applied to the motor of the compressor; a stroke calculator 50 for calculating a stroke estimate value of the compressor 60 based on the detected current and voltage values and a parameter of the motor; a back electromotive force calculator 70 for calculating a back electromotive force based on the voltage value of the voltage detector 30 and the current value of the current detector 40; an operation frequency reference value determining unit 80 for detecting a mechanical resonance frequency of the compressor based on the calculated back electromotive force value and the detected current value and determining the detected mechanical resonance frequency as an operation frequency reference value; a comparator 10 for comparing the stroke estimate value outputted from the stroke calculator 50 with a stroke reference value and outputting a difference value according to the comparison result; and a controller 20 for controlling an operation of the compressor 60 by varying a current operation frequency according to the determined operation frequency reference value and varying a voltage applied to the motor of the compressor 60 according to the difference value outputted from the comparator 10.

The operation of the apparatus for controlling an operation of the compressor in accordance with the present invention will be described as follows.

First, the current detector 40 detects a current applied to the compressor 60 and outputs the detected current value to the stroke calculator 50, the back electromotive force calculator 70 and the operation frequency reference value determining unit 80. At this time, the voltage detector 30 detects a voltage applied to the compressor 60 and outputs the detected voltage to the stroke calculator 50 and the back electromotive calculator 70.

The stroke calculator 50 calculates a stroke estimate value of the compressor 60 based on the current value outputted from the current detector 10, the voltage value outputted from the voltage detector 20 and the pre-set parameter of the motor, and then, outputs the calculated stroke estimate value to the comparator 10.

The comparator 10 compares the stroke reference value with the stroke estimate value outputted from the stroke calculator 50, and outputs the difference value according to the comparison result to the controller 20.

The controller 20 controls a stroke of the compressor by varying the voltage applied to the compressor 60 according to the difference value outputted from the comparator 10.

Meanwhile, the back electromotive force calculator 70 calculates a back electromotive force (BEMF) of the compressor 60 based on the voltage value detected by the voltage detector 30 and the current value detected by the current detector 40. Preferably, the BEMF is calculated through equation (2) shown below:

$$BEMF = V_M - Ri - L\frac{di}{dt} \tag{2}$$

wherein 'R' is a motor resistance value, 'L' is a motor inductance value, $V_M$ is a value of a voltage applied to the motor and 'i' is a value of a current applied to the motor.

The operation frequency reference value determining unit 80 detects a mechanical resonance frequency of the compressor based on the BEMF value and the current value, and determines the detected mechanical resonance frequency as an operation frequency reference value. For example, when the motor is in the resonant state, all of the values obtained by multiplying values of BEMF during one period and the detected current values have a positive (+) value, so that the sum of the multiplied values is a maximum value. Namely, when the sum of values obtained by multiplying the BEMF values of the motor and the detected current values is the maximum value, the operation frequency becomes equivalent to the mechanical resonance frequency.

Accordingly, the operation frequency reference value determining unit 80 recognizes an operation frequency detected when the sum of values obtained by multiplying the BEMF values and the detected current values is the maximum value as a mechanical resonance frequency, and determines the mechanical resonance frequency as the operation frequency reference value. Herein, when the operation frequency and the mechanical resonance frequency are identical, operation efficiency of the compressor is enhanced.

The mechanical resonance frequency value can be detected through equation (3) shown below:

$$\Sigma(\mathrm{BEMF} \times i) \tag{3}$$

That is, the operation frequency reference value determining unit 80 recognizes the operation frequency obtained when a value calculated through equation (3) is the maximum as the mechanical resonance frequency and determines the recognized mechanical resonance frequency as the operation frequency reference value. Herein, the BEMF is a back electromotive force and 'i' is a value of a current applied to the motor.

Thereafter, the controller 20 controls an operation of the compressor 60 by varying a current operation frequency of the compressor 60 according to the operation frequency reference value outputted from the operation frequency reference value determining unit 80. Namely, if the operation frequency reference value is greater than the current operation frequency value, the controller increases the current operation frequency, whereas if the operation frequency reference value is smaller than the current operation frequency value, the controller reduces the current operation frequency.

FIGS. 4A to 4C are graphs showing a phase of a current applied to a motor of the compressor and a velocity of the motor, namely, showing states of the mechanical resonance frequency and the operation frequency when the sum of values obtained by multiplying the velocity values and current values during one period is the maximum or not.

As shown in FIGS. 4A to 4C, in the present invention, it was revealed through experimentation that even though a load of the compressor is changed, when the sum of values obtained by multiplying the back electromotive force values of the motor and values of a current applied to the motor is maximum, a resonance phenomenon occurs.

Herein, the reason why the current values and the velocity values during one period are multiplied, not that the current values and the back electromotive force values during one period are multiplied, is because the back electromotive force generated from the motor is in proportion to the velocity, so the velocity phase and the current phase of the motor are shown in graphs and the current values and the velocity values are multiplied. In other words, in principle, if the mechanical resonance frequency is the same as the operation frequency, the phase of the current and the phase of the velocity becomes the same. At this time, when the sum of the values obtained by multiplying the current values and the velocity values is the maximum, the phase of the current and the phase of the velocity are equal to each other.

FIG. 4A is a graph showing that a phase of a current applied to the motor of the compressor and a phase of a velocity of the motor are the same and a mechanical resonance frequency and an operation frequency are the same.

As shown in FIG. 4A, when the phase of the current and the phase of the velocity are the same, values obtained by multiplying the current values and the velocity values during one period have only the positive (+) values, so that the sum of the values obtained by multiplying the current values and the velocity values is the maximum.

FIG. 4B is a graph showing that a phase of the current applied to the motor of the compressor leads a phase of the velocity of the motor and an operation frequency is greater than a mechanical resonance frequency.

As shown in FIG. 4B, when the phase of the current applied to the motor of the compressor leads the phase of the velocity of the motor, the values obtained by multiplying current values and velocity values during one period have the negative (−) value and the positive (+) value. Accordingly, the sum of values obtained by multiplying the current values and the velocity values in the case that the phase of the current leads the phase of the velocity, is smaller than the sum of values obtained by multiplying the current values and the velocity values in the case that the phase of the current and the phase of the velocity are the same.

FIG. 4C is a graph showing that the phase of the current applied to the motor of the compressor lags behind the phase of the velocity and the operation frequency is smaller than the mechanical resonance frequency.

As shown in FIG. 4C, when the phase of the current lags behind the phase of the velocity, the values obtained by multiplying current values and velocity values during one period have a negative (−) value and positive (+) value. Accordingly, the sum of values obtained by multiplying the current values and the velocity values in the case that the phase of the current lags behind the phase of the velocity is smaller than the sum of values obtained by multiplying the current values and the velocity values in the case that the phase of the current and the phase of the velocity are the same.

The operation of the operation frequency reference value determining unit 80 for multiplying the back electromotive force values and the current values during one period, adding the multiplied values, detecting an operation frequency when the sum is the maximum value, and determining the detected operation frequency value as an operation frequency reference value, will now be described in detail with reference to FIG. 5.

FIG. 5 is a flow chart of a method for controlling the operation of the reciprocating compressor in accordance with the present invention.

As shown in FIG. 5, the method for controlling an operation of the compressor in accordance with the present invention includes: detecting a value of a current and a value of a voltage applied to the compressor 60; calculating a back electromotive force of the compressor based on the current and voltage values; detecting a mechanical resonance frequency of the compressor based on the sum of values obtained by multiplying back electromotive force values and current values during one period and determining the mechanical resonance frequency as an operation frequency reference value; and varying a current operation frequency of the compressor based on the determined operation frequency reference value.

The operation frequency in case that the sum of values obtained by multiplying the back electromotive force values and the current values during one period is the maximum is identical to the mechanical resonance frequency of the compressor. Accordingly, when a current operation frequency is varied according to the operation frequency in the case that the sum of values obtained by multiplying the back electromotive force values and the current values during one period is the maximum, the varied operation frequency becomes identical to the mechanical resonance frequency, and thus, operation efficiency of the compressor can be enhanced.

First, the operation frequency reference value determining unit 80 calculates the sum of values obtained by multiplying the back electromotive force values and the current values during one period (step S11) and compares the calculated sum with the sum of values obtained by multiplying back electromotive force values and current values during a previous one period (step S12).

If the sum of the values obtained by multiplying the back electromotive force values and the current values during one period is greater than the sum of the values obtained by multiplying the back electromotive force values and the current values during a previous one period and the current operation frequency of the compressor 60 is greater than a previous operation frequency, the operation frequency reference value determining unit 80 continuously increases the current operation frequency and then determines an operation frequency (identical to the mechanical resonance frequency) when the sum of values obtained by multiplying the back electromotive force values and the current values during one period is the maximum as an operation frequency reference value (steps S13 and S15).

If the sum of the values obtained by multiplying the back electromotive force values and the current values during one period is greater than the sum of the values obtained by multiplying the back electromotive force values and the current values during a previous one period and the current operation frequency of the compressor 60 is smaller than a previous operation frequency, the operation frequency reference value determining unit 80 continuously reduces the current operation frequency and then determines an operation frequency when the sum of values obtained by multiplying the back electromotive force values and the current values during a current one period is the maximum as an operation frequency reference value (steps S13 and S16).

If the sum of the values obtained by multiplying the back electromotive force values and the current values during one period is smaller than the sum of the values obtained by multiplying the back electromotive force values and the current values during a previous one period and the current operation frequency of the compressor 60 is smaller than a previous operation frequency, the operation frequency reference value determining unit 80 continuously increases the current operation frequency and then determines an operation frequency when the sum of values obtained by multiplying the back electromotive force values and the current values during a current one period is the maximum as an operation frequency reference value (steps S14 and S17).

If the sum of the values obtained by multiplying the back electromotive force values and the current values during one period is smaller than the sum of the values obtained by multiplying the back electromotive force values and the current values during a previous one period and the current operation frequency of the compressor 60 is greater than a previous operation frequency, the operation frequency reference value determining unit 80 continuously reduces the current operation frequency and then determines an operation frequency when the sum of values obtained by multiplying the back electromotive force values and the current values during a current one period is the maximum as an operation frequency reference value (steps S14 and S18).

Therefore, the operation frequency when the sum of the values obtained by multiplying the back electromotive force values and the current values during one period is the maximum is identical to the mechanical resonance frequency of the compressor, so that operation efficiency of the compressor can be enhanced by varying the current operation frequency according to the operation frequency when the sum of the values obtained by multiplying the back electromotive force values and the current values during one period.

In other words, while the reciprocating compressor is operating, whenever a load of the compressor is varied, a mechanical resonance frequency of the compressor is detected based on the back electromotive force values and the current values during one period and then the operation frequency of the compressor is varied according to the detected mechanical resonance frequency, whereby the operation efficiency of the compressor can be enhanced.

As so far described, the apparatus and method for controlling an operation of a reciprocating compressor in accordance with the present invention has the following advantages.

That is, whenever a load of the compressor is varied, a mechanical resonance frequency of the compressor is detected based on back electromotive force values and current values during one period and an operation frequency of the compressor is varied according to the detected mechanical resonance frequency. Accordingly, even when the load of the compressor is varied, operation efficiency of the compressor can be enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An apparatus for controlling an operation of a compressor comprising:

a back electromotive force calculator for calculating a back electromotive force of the compressor based on a value of a current applied to a motor of the compressor and a value of a voltage applied to the motor of the compressor;

an operation frequency reference value determining unit for detecting a mechanical resonance frequency of the compressor based on the back electromotive force value and the current value and determining the detected mechanical resonance frequency as an operation frequency reference value; and a controller for varying an operation frequency of the compressor according to the determined operation frequency reference value, wherein the operation frequency reference value determining unit multiplies back electromotive force (BEMF) values and current values during one time period and determines an operation frequency when the sum of multiplied values is the maximum as the operation frequency reference value wherein the one time period corresponds to one oscillation cycle of the compressor.

2. The apparatus of claim 1, wherein when the sum of the multiplied values is the maximum, the operation frequency is identical to a mechanical frequency of the compressor.

3. The apparatus of claim 1, wherein the BEMF is calculated through equation shown below:

$$BEMF = V_M - Ri - L\frac{di}{dt},$$

wherein 'R' is a motor resistance value, 'L' is a motor inductance value, $V_M$ is a value of a voltage applied to the motor, and 'i' is a value of a current applied to the motor.

4. The apparatus of claim 1, wherein if the sum of the values obtained by multiplying the back electromotive force values and the current values during the one time period is greater than the sum of the values obtained by multiplying the back electromotive force values and the current values during a previous one time period and the current operation frequency is greater than a previous operation frequency, the operation frequency reference value determining unit continuously increases the current operation frequency and then determines the operation frequency when the sum of values obtained by multiplying the back electromotive force values and the current values during a current one time period is the maximum as the operation frequency reference value.

5. The apparatus of claim 1, wherein if the sum of the values obtained by multiplying the back electromotive force values and the current values during the one time period is greater than the sum of the values obtained by multiplying the back electromotive force values and the current values during a previous one time period and the current operation frequency is smaller than a previous operation frequency, the operation frequency reference value determining unit continuously reduces the current operation frequency and then determines the operation frequency when the sum of values obtained by multiplying the back electromotive force values and the current values during a current one time period is the maximum as the operation frequency reference value.

6. The apparatus of claim 1, wherein if the sum of the values obtained by multiplying the back electromotive force values and the current values during the one time period is smaller than the sum of the values obtained by multiplying the back electromotive force values and the current values during a previous one time period and the current operation frequency is smaller than a previous operation frequency, the operation frequency reference value determining unit continuously increases the current operation frequency and then determines the operation frequency when the sum of values obtained by multiplying the back electromotive force values and the current values during a current one time period is the maximum as the operation frequency reference value.

7. The apparatus of claim 1, wherein if the sum of the values obtained by multiplying the back electromotive force values and the current values during the one time period is smaller than the sum of the values obtained by multiplying the back electromotive force values and the current values during a previous one time period and the current operation frequency is greater than a previous operation frequency, the operation frequency reference value determining unit continuously reduces the current operation frequency and then determines the operation frequency when the sum of values obtained by multiplying the back electromotive force values and the current values during a current one time period is the maximum as the operation frequency reference value.

8. An apparatus for controlling an operation of a compressor comprising:

a current detector for detecting a current applied to a motor of the compressor;

a voltage detector for detecting a voltage applied to the motor;

a stroke calculator for calculating a stroke estimate value based on the detected current and voltage values and a parameter of the motor;

a back electromotive force calculator for calculating a back electromotive force of the motor based on the voltage value of the voltage detector and the current value of the current detector;

an operation frequency reference value determining unit for detecting a mechanical resonance frequency of the compressor based on the obtained back electromotive force value and the detected current value and determining the detected mechanical resonance frequency as an operation frequency reference value;

a comparator for comparing the stroke estimate value outputted from the stroke calculator with a stroke reference value and outputting a difference value according to the comparison result; and a controller for controlling an operation of the compressor by varying a current operation frequency according to the determined operation frequency reference value and varying the voltage applied to the motor of the compressor according to the difference value outputted from the comparator, wherein the operation frequency reference value determining unit multiplies back electromotive force (BEMF) values and current values during one time period and determines an operation frequency when the sum of multiplied values is the maximum as the operation frequency reference value wherein the one time period corresponds to one oscillation cycle of the compressor.

9. The apparatus of claim 8, wherein the operation frequency reference value determining unit multiplies back electromotive force (BEMF) values and current values during one period, recognizing an operation frequency detected when the sum of the multiplied values is the maximum as a mechanical resonance frequency of the compressor, and determining the mechanical resonance frequency as the operation frequency reference value.

10. The apparatus of claim 8, wherein the BEMF is calculated through equation shown below:

$$BEMF = V_M - Ri - L\frac{di}{dt},$$

wherein 'R' is a motor resistance value, 'L' is a motor inductance value, $V_M$ is a value of a voltage applied to the motor, and 'i' is a value of a current applied to the motor.

11. The apparatus of claim 8, wherein if the sum of the values obtained by multiplying the back electromotive force values and the current values during the one time period is greater than the sum of the values obtained by multiplying the back electromotive force values and the current values during a previous one time period and the current operation frequency is greater than a previous operation frequency, the operation frequency reference value determining unit continuously increases the current operation frequency and then determines the operation frequency when the sum of values obtained by multiplying the back electromotive force values and the current values during a current one time period is the maximum as the operation frequency reference value.

12. The apparatus of claim 8, wherein if the sum of the values obtained by multiplying the back electromotive force values and the current values during the one time period is greater than the sum of the values obtained by multiplying the back electromotive force values and the current values during a previous one time period and the current operation frequency is smaller than a previous operation frequency, the operation frequency reference value determining unit continuously reduces the current operation frequency and then determines the operation frequency when the sum of values obtained by multiplying the back electromotive force values and the current values during a current one time period is the maximum as the operation frequency reference value.

13. The apparatus of claim 8, wherein if the sum of the values obtained by multiplying the back electromotive force values and the current values during one time period is smaller than the sum of the values obtained by multiplying the back electromotive force values and the current values during a previous one time period and the current operation frequency is smaller than a previous operation frequency, the operation frequency reference value determining unit continuously increases the current operation frequency and then determines an operation frequency when the sum of values obtained by multiplying the back electromotive force values and the current values during a current one time period is the maximum as an operation frequency reference value.

14. The apparatus of claim 8, wherein if the sum of the values obtained by multiplying the back electromotive force values and the current values during one time period is smaller than the sum of the values obtained by multiplying the back electromotive force values and the current values during a previous one time period and the current operation frequency is greater than a previous operation frequency, the operation frequency reference value determining unit continuously reduces the current operation frequency and then determines an operation frequency when the sum of values obtained by multiplying the back electromotive force values and the current values during a current one time period is the maximum as an operation frequency reference value.

15. A method for controlling an operation of a compressor comprising:

calculating a back electromotive force of a motor of the compressor based on a value of a current applied to the motor of the compressor and a value of a voltage applied to the motor of the compressor;

detecting a mechanical resonance frequency of the compressor based on the back electromotive force value and the value of the current; determining the mechanical resonance frequency as an operation frequency reference value of the compressor; and varying an operation frequency of the compressor according to the determined operation frequency reference value, wherein the step of determining the operation frequency reference value comprises multiplying back electromotive force values and current values during one time period, adding the multiplied values, and determining the operation frequency detected when the sum of the multiplied values is the maximum as the operation frequency reference value.

16. The method of claim 15, wherein, in the step of determining the operation frequency as the operation frequency reference value, in order to make the operation frequency of the compressor identical to the mechanical resonance frequency of the compressor, the operation frequency detected when the sum of the multiplied values is the maximum is determined as the operation frequency reference value.

17. The method of claim 15, wherein the step of determining the mechanical resonance frequency as the operation frequency reference value comprises:

a step in which if the sum of the values obtained by multiplying the back electromotive force values and the current values during the one time period is greater than the sum of the values obtained by multiplying the back electromotive force values and the current values during a previous one time period and the current operation frequency of the compressor is greater than a previous operation frequency, the current operation frequency is continuously increased and the operation frequency detected when the sum of values obtained by multiplying the back electromotive force values and the current values during a current one time period is the maximum, is determined as the operation frequency reference value;

a step in which if the sum of the values obtained by multiplying the back electromotive force values and the current values during the one time period is greater than the sum of the values obtained by multiplying the back electromotive force values and the current values during the previous one time period and the current operation frequency is smaller than the previous operation frequency, the current operation frequency is continuously reduced and the operation frequency detected when the sum of values obtained by multiplying the back electromotive force values and the current values during the current one time period is the maximum, is determined as the operation frequency reference value;

a step in which if the sum of the values obtained by multiplying the back electromotive force values and the current values during the one time period is smaller than the sum of the values obtained by multiplying the back electromotive force values and the current values during the previous one time period and the current operation frequency is smaller than the previous operation frequency, the current operation frequency is continuously increased and the operation frequency detected when the sum of values obtained by multiplying the back electromotive force values and the current values during the current one time period is the maximum, is determined as the operation frequency reference value; and a step in which if the sum of the values obtained by multiplying the back electromotive force values and the current values during the one time period is smaller than the sum of the values obtained by multiplying the back electromotive force values and the current values during the previous one time period and the current operation frequency is greater than the previous operation frequency, the current operation frequency is continuously reduced and the operation frequency detected when the sum of values obtained by multiplying the back electromotive force values and the current values during the current one time period is the maximum, is determined as the operation frequency reference value.

* * * * *